US007321813B2

(12) United States Patent
Meunier

(10) Patent No.: US 7,321,813 B2
(45) Date of Patent: Jan. 22, 2008

(54) ANTICOLLISION EQUIPMENT ON BOARD AN AEROPLANE WITH NORMAL FLIGHT REVERSION AID

(75) Inventor: Hugues Meunier, Frouzins (FR)

(73) Assignee: Thales, Neuilly/Sur/Seine (FR)

( * ) Notice: Subject to any disclaimer, the term of this patent is extended or adjusted under 35 U.S.C. 154(b) by 253 days.

(21) Appl. No.: 10/538,076

(22) PCT Filed: Dec. 2, 2003

(86) PCT No.: PCT/EP03/50921

§ 371 (c)(1),
(2), (4) Date: Jun. 9, 2005

(87) PCT Pub. No.: WO2004/055752

PCT Pub. Date: Jul. 1, 2004

(65) Prior Publication Data

US 2006/0052912 A1 Mar. 9, 2006

(30) Foreign Application Priority Data

Dec. 13, 2002 (FR) ..... 02 15841

(51) Int. Cl.
*G08G 3/02* (2006.01)

(52) U.S. Cl. ..... 701/10; 342/29

(58) Field of Classification Search ..... 701/10, 701/8, 9, 16, 17; 340/947, 948, 951, 954, 340/960, 961, 976, 979, 967; 342/29, 36, 342/65, 455

See application file for complete search history.

(56) References Cited

U.S. PATENT DOCUMENTS 4,567,483 A * 1/1986 Bateman et al. ..... 340/970
5,892,462 A 4/1999 Tran
6,088,654 A * 7/2000 Lepere et al. ..... 701/301
6,347,263 B1 2/2002 Johnson et al.
6,438,492 B1 * 8/2002 Le Tallec et al. ..... 701/301
6,567,728 B1 * 5/2003 Kelly et al. ..... 701/9
6,707,394 B2 * 3/2004 Ishihara et al. ..... 340/970
6,826,459 B2 * 11/2004 Conner et al. ..... 701/9

(Continued)

FOREIGN PATENT DOCUMENTS

EP 0 597 760 A 5/1994

(Continued)

*Primary Examiner*—Dalena Tran
(74) *Attorney, Agent, or Firm*—Lowe Hauptman Ham & Berner, LLP

(57) ABSTRACT

Conventional terrain anticollision equipment formulates, around the short term forecast trajectory of the aircraft which is equipped therewith, virtual volumes of protection of maneuver charted by feelers and signals a risk of terrain collision as soon as it detects an intrusion of the terrain into these virtual volumes of protection of maneuver. The terrain anticollision equipment proposed provides the crew with, in addition to the prealarms and alarms of risk of terrain collision, an indication of possibility of cessation of an avoidance maneuver instigated in order to resolve a risk of terrain collision, in the form either of a stoppage of an aural and/or luminous cue to continue the avoidance maneuver, or of the momentary generation of an aural and/or luminous cue of possible end of the avoidance maneuver, formulated by means of a feeler specific to route resumption, the absence of contact of the terrain with this feeler specific to route resumption being used to note the definitive resolution of a risk of terrain collision.

22 Claims, 5 Drawing Sheets

U.S. PATENT DOCUMENTS 6,906,641 B2 * 6/2005 Ishihara ..... 340/946
6,922,703 B1 * 7/2005 Snyder et al. ..... 707/104.1

FOREIGN PATENT DOCUMENTS

EP 0 790 487 8/1997
FR 2 773 609 A 7/1999
FR 2 813 963 A 3/2002
WO 98/38619 A 9/1998

* cited by examiner

ANTICOLLISION EQUIPMENT ON BOARD AN AEROPLANE WITH NORMAL FLIGHT REVERSION AID

CROSS-REFERENCE TO RELATED APPLICATIONS

The present Application is based on International Application No. PCT/EP2003/050921, filed on Dec. 2, 2003, which in turn corresponds to FR 02/15841 filed on Dec. 13, 2002, and priority is hereby claimed under 35 USC §119 based on these applications. Each of these applications are hereby incorporated by reference in their entirety into the present application.

FIELD OF THE INVENTION

The present invention relates to the prevention of aeronautical accidents in which a still maneuverable aircraft crashes with the ground. This type of accident, which represents a significant percentage of past civil air catastrophes, is known in the technical literature by the initials CFIT standing for "Controlled Flight Into Terrain".

DESCRIPTION OF THE RELATED ART

To combat the risks of CFIT various ground proximity alert equipment has been introduced onboard aircraft.

A first generation of ground proximity alert equipment called GPWS (the acronym standing for "Ground Proximity Warning System") monitors the height of the aircraft above the ground as measured by a radio altimeter and cross-checks it:

- either with the vertical descent speed of the aircraft as measured by a barometric altimeter and/or an inertial rig, the cross-check being done by simple comparison (mode 1) or, in a more sophisticated manner, by non-linear filtering (mode 2),
- or with an earlier measurement of the height above the ground so as to signal abnormal loss of altitude during a take-off or a missed approach (mode 3),
- or with the air speed of the aircraft and the positions of the landing gear and the flaps (mode 4),
- or with the vertical error of presentation of the aircraft in the guidance beam of an ILS (the acronym standing for "Instrument Landing System") during a landing (mode 5),
- or again with the position of the aircraft in proximity to a runway (call-out),
- or with the angle of roll, to trigger an audible and/or visual alert in the cockpit in the case of detection of dangerous closeness to the ground.

Despite this first generation of GPWS equipment the percentage of aeronautical accidents of CFIT type has remained high, essentially, for the following reasons:

- ground proximity alert late or even missing due to the very principle of the detection of risks of collision with the ground by a radio probe looking under the aircraft and not in front of the aircraft,
- ground proximity alarm missing following a temporary reduction, by the crew, of the sensitivity of the GPWS equipment with a view to limiting false alarms (such is generally the case for accidents occurring during a final approach to a landing field),
- ground proximity alert late since the thresholds for triggering the GPWS equipment have been momentarily raised again to limit the false alarms during a final approach to a landing field,
- ground proximity alert in time but the crew has reacted too late or has not reacted on account of a desensitization of the equipment resulting from the overly high rate of false alarms, due mainly to a prediction of risk of collision each time that terrain begins to rise under the aircraft in a dangerous manner or otherwise.

The need to improve this first generation ground alert GPWS equipment has therefore rapidly made itself felt. The path followed has been that of increasing the information taken into account by the ground alert equipment relating to the terrain situated in front of and to the sides of the short term scheduled trajectory of the aircraft by profiting from the advent of accurate positioning systems such as satellite-based positioning systems and digitized relief maps that can be stored in onboard data bases.

To meet this need for improvement, a second generation of ground proximity alert equipment called TAWS (the acronym standing for "Terrain Awareness Warning System") has appeared, fulfilling, in addition to the customary GPWS functions, an additional function of predictive alert of risks of collision with the relief and/or ground obstacles called FLTA (the acronym standing for "predictive Forward-Looking Terrain collision Awareness and alerting) or else GCAS (the acronym standing for "Ground Collision Avoidance System"). This FLTA function consists in providing the crew with prealerts and alerts whenever the short term scheduled trajectory of the aircraft meets the relief and/or an obstacle on the ground so that an avoidance maneuver is engaged.

The short term scheduled trajectory of the aircraft is provided by the navigation equipment of the aircraft from a measurement, in three dimensions, of the instantaneous position and of the speed vector of the aircraft, given by an onboard positioning system, typically: satellite-based positioning receiver and/or inertial rig. The relief and/or the ground obstacles form the subject of a topographical representation extracted from a terrain and/or obstacles data base, carried onboard the aircraft or on the ground but accessible from the aircraft by its radiocommunication means.

The FLTA function determines the short term scheduled trajectory of the aircraft from information provided by the navigation equipment of the aircraft, so as to delimit one or more protection volumes around the current position and current trajectory of the aircraft and to produce alarms of risk of collision with the relief and/or ground obstacles with each intrusion, into these protection volumes, of the relief and/or of ground obstacles overflown, modeled using a topographical representation extracted from the terrain and/or obstacles data base.

An aircraft related protection volume is a part of space in which the aircraft is liable to deploy in a more or less near future. Its significance and its form depend on the delay sought between an alarm and the realization of a risk of collision, and to a certain measure on the maneuverability of the aircraft at the instant considered, that is to say on the aircraft's maneuver capabilities that are related to its performance, to the modulus and to the direction of its air speed, and to its flight attitude (flight in a straight line or turn, etc). It is defined by its lower and frontal and, possibly, lateral walls.

When a risk of collision is detected by the FLTA function, it is customary to produce, intended for the crew of the aircraft, a prealarm followed by an alarm.

In this case, the FLTA function calls upon at least two protection volumes directed toward the front according to the predicted future trajectory and toward the underneath of the aircraft. A first protection volume, the most distant from the aircraft, is used to generate a prealarm while a second protection volume closer to the aircraft is used to generate an alarm.

The aim of the prealarm is to make the crew aware of a short term risk of collision with the terrain and/or ground obstacles so that they take account thereof in the piloting of the aircraft. It is given sufficiently in advance for the crew to be able to correct its trajectory and prepare to perform a possible avoidance maneuver. It consists for example, of a repetitive audible warning of the type: "Caution Terrain" twinned or otherwise with a luminous signaling and accompanied or otherwise by a specific symbology on a display screen (yellow zone for example) of the cockpit.

The alarm forewarns the crew of a very short term risk of collision with the terrain and/or ground obstacles while advising them strongly to perform an immediate avoidance maneuver, in general of "pull-up" type. This is for example a repetitive audible warning of the type: "Terrain Terrain, Pull up" that can also be twinned with a luminous signaling and accompanied or otherwise by a specific symbology on a display screen (red zone for example) of the cockpit. When a maneuver of "Pull-up" type is not deemed feasible by the system, another alarm may be emitted (for example "Avoid Terrain").

When the short term or very short term risk of collision with the terrain and/or with ground obstacles that motivated a prealarm or an alarm disappears in particular on account of the execution of an appropriate avoidance maneuver, the prealarm or the alarm is lifted and the audible and/or luminous warnings suppressed.

Such a device forms the subject of French patents FR 2 689 668, FR 2 747 492, FR 2 773 609, FR 2 813 963 and of corresponding American patents U.S. Pat. Nos. 5,488, 563, 5,638,282, 6,088,654 whose descriptive content should be regarded as incorporated wholly with the present description.

Often, the FLTA function is associated with a device for displaying the risks of terrain collision displaying on one or more screens installed onboard an image representing in two dimensions an envelope of the terrain and/or of the obstacles overflown while highlighting the risks of collision, with their relative significances, that are incurred on account of the various terrain and/or obstacles in range of the aircraft.

Such a display device has formed the subject of French patent FR 2 773 609 and of American patent U.S. Pat. No. 6,088,654 corresponding thereto which have already been cited.

The ground anticollision equipment known at present, though it makes it possible to detect the risks of ground collision and to prevent them through an appropriate avoidance maneuver, does not however make it possible to accurately ascertain the instant from which a terrain and/or ground obstacles avoidance maneuver, instigated in an appropriate manner to deal with a risk of collision with the terrain and/or obstacles on the ground, may be terminated and from which the resumption of a normal flight may be envisaged. Specifically, the prealarm or the alarm stops as soon as the short term or very short term risk of collision with the terrain and/or with ground obstacles that motivated it disappears in particular on account of the execution of an appropriate avoidance maneuver that diverts the short term scheduled trajectory of the aircraft sufficiently from the terrain and/or the ground obstacles overflown, this possibly occurring although the aircraft is climbing, without having yet reached the scheduled safety altitude for the place considered.

Neither does the cartographic display of contemporary ground anticollision equipment clearly advise as to the instant at which a risk of ground collision is actually resolved unless it uses an altitude related to the instantaneous altitude of the aircraft as display altitude reference altitude.

As they receive no end of avoidance maneuver signal on the part of the terrain and/or ground obstacles collision risk alert equipment, the crew of an aircraft wait to be appreciably above the safety altitude fixed for the zone overflown in order to end a terrain and/or ground obstacles avoidance maneuver, this conspiring to prolong the flight time.

SUMMARY OF THE INVENTION

An aim of the present invention is to alleviate the aforesaid drawback by giving the crew a clear indication of the instant from which the terrain conflict may be regarded as resolved and the avoidance maneuver may be terminated, doing so by the means of appropriate aural and/or visual announcements and/or by an appropriate display on one or more onboard screens giving a representation of the terrain and/or of the obstacles overflown.

A subject of the present invention is terrain anticollision equipment carried onboard an aircraft, comprising means for determining at least one virtual envelope of protection of maneuver of the aircraft constructed around the short term predicted trajectory of the aircraft and delimiting a protection volume around the current position and the current trajectory of the aircraft, means for detecting intrusions, into said virtual envelope or envelopes of protection of maneuver, of a representation of an envelope of the terrain and/or of the ground obstacles overflown stored in a data base onboard or on the ground, and alarm means triggered by the intrusion detection means. This terrain anticollision equipment is noteworthy in that, after detection of a risk of ground collision, its means of determining virtual envelopes of protection provide, in addition to the virtual envelopes of protection of maneuver, at least one virtual envelope of protection of resumption of route, constructed around a fictitious trajectory of resumption of route, in that its means of intrusion detection detect the intrusions of the terrain and/or of the ground obstacles at one and the same time into the virtual envelope or envelopes of protection of maneuver and into the virtual envelope or envelopes of protection of resumption of route and in that its alarm means produce an indication signaling the possibility of ending an avoidance maneuver as soon as the means of intrusion detection no longer note any intrusion of the terrain and/or of the ground obstacles into the virtual envelope or envelopes of protection of resumption of route.

Advantageously, the fictitious trajectory of resumption of route is a horizontal trajectory.

Advantageously, the fictitious trajectory of resumption of route is a trajectory having as slopes, a horizontal slope if the instantaneous trajectory of the aircraft is climbing or holding level, and a slope dependent on the instantaneous trajectory of the aircraft if the aircraft is descending.

Advantageously, the fictitious trajectory of resumption of route is a trajectory having as slopes, a slope dependent on the instantaneous trajectory of the aircraft.

Advantageously, the fictitious trajectory of resumption of route is a trajectory having as slopes, a slope dependent on the trajectory of the aircraft at the moment of the detection of the risk of terrain collision.

Advantageously, the fictitious trajectory of resumption of route is a trajectory having as slopes, a slope dependent on the trajectory of the aircraft at the moment of the detection of the risk of terrain collision, if the latter was descending, and a horizontal trajectory if the latter was flying horizontally or climbing at the moment of the detection of the risk of terrain collision.

Advantageously, the fictitious trajectory of resumption of route is a trajectory having as heading the instantaneous heading of the aircraft.

Advantageously, the fictitious trajectory of resumption of route is a trajectory having as heading and slope those of the trajectory of the aircraft at the moment of the detection of the risk of terrain collision.

Advantageously, the limits of the virtual envelope or envelopes of protection are defined by a so-called feeler surface the meeting of which with the representation of an envelope of the terrain and/or of the ground obstacles which is extracted from the information of the data base is regarded as an intrusion of the terrain and/or of the ground obstacles into the corresponding virtual envelope of protection.

Advantageously, regardless of the instantaneous attitude of the aircraft: (climbing, flying level or descending), the projection onto the horizontal of a feeler of virtual envelope of protection of maneuver is adopted as feeler of a virtual envelope of protection of resumption of route.

Advantageously, when the instantaneous attitude of the aircraft is climbing or flying level, the projection onto the horizontal of a feeler of virtual envelope of protection of maneuver is adopted as feeler of a virtual envelope of protection of resumption of route.

Advantageously, when the instantaneous attitude of the aircraft is descending, the projection according to an inclined plane dependent on the instantaneous descent slope of the aircraft of a feeler of virtual envelope of protection of maneuver is adopted as feeler of a virtual envelope of protection of resumption of route.

Advantageously, when the instantaneous attitude of the aircraft is descending, the projection along an inclined plane dependent on the instantaneous descent slope of the aircraft of a feeler of virtual envelope of protection of maneuver during a certain distance or flight time and then according to the horizontal is adopted as feeler of a virtual envelope of protection of resumption of route.

Advantageously, when the terrain anticollision equipment is provided with a display screen showing a representation of the terrain layers and/or of the risks of collision with the terrain and/or the obstacles overflown, the projection, in two planes, which is adopted as feeler of a virtual envelope of protection of resumption of route is carried out in a manner consistent with that used on the screen for the representation of the terrain layers and/or of the risks of collision with the terrain and/or the obstacles overflown.

Advantageously, when the aircraft was climbing or holding level at the moment of the detection of a risk of terrain collision, the projection onto the horizontal of a feeler of virtual envelope of protection of maneuver is adopted as feeler of a virtual envelope of protection of resumption of route.

Advantageously, when the aircraft was descending at the moment of the detection of a risk of terrain collision, the projection, along an inclined plane dependent on the descent slope of the aircraft at the moment of the detection of the risk of terrain collision, of a feeler of virtual envelope of protection of maneuver is adopted as feeler of a virtual envelope of protection of resumption of route.

Advantageously, when the means of determination of virtual envelope of protection produce two virtual envelopes of protection of maneuver, the more distant for a prealarm of terrain collision and the closer for an alarm of terrain collision, the union of the projections onto the horizontal of the feelers of the two virtual envelopes of protection of maneuver is adopted as feeler of a virtual envelope of protection of resumption of route.

Advantageously, when the means of determination of virtual envelope of projection produce two virtual envelopes of protection of maneuver, the more distant for a prealarm of terrain collision and the closer for an alarm of terrain collision, the union of the projections, along an inclined plane having the descent slope of the aircraft at the moment of the detection of the risk of terrain collision, of the feelers of the two virtual envelopes of protection of maneuver is adopted as feeler of a virtual envelope of protection of resumption of route.

Advantageously, the indication signaling the possibility of ending an avoidance maneuver is given momentarily in aural and/or visual form.

Advantageously, the terrain autocollision equipment produces an indication of holding of the avoidance maneuver in aural and/or visual form, upon the disappearance of a terrain alert and does so, until no risk of collision is detected by the virtual envelope of protection of resumption of route.

Advantageously, the vertical distance under the aircraft at which the virtual envelope of protection of resumption of route is placed is taken equal to that used for one of the virtual envelopes of protection of maneuver.

Advantageously, when the terrain anticollision equipment is provided with a display screen showing a representation of the terrain layers and/or of the risks of collision with the terrain and/or the obstacles overflown, the vertical distance under the aircraft at which a virtual envelope of protection of resumption of route is placed is taken consistent with that used on the screen for the representation of the terrain layers and/or of risks of collision with the terrain and/or the obstacles overflown.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

Other characteristics and advantages of the invention will emerge from the description below of an embodiment given by way of example. This description will be offered in conjunction with the drawing in which.

a FIG. 1 is a basic diagram of terrain anticollision equipment carried onboard an aircraft with a view to making the piloting thereof safe.

DETAILED DESCRIPTION OF THE INVENTION

Figure 1:
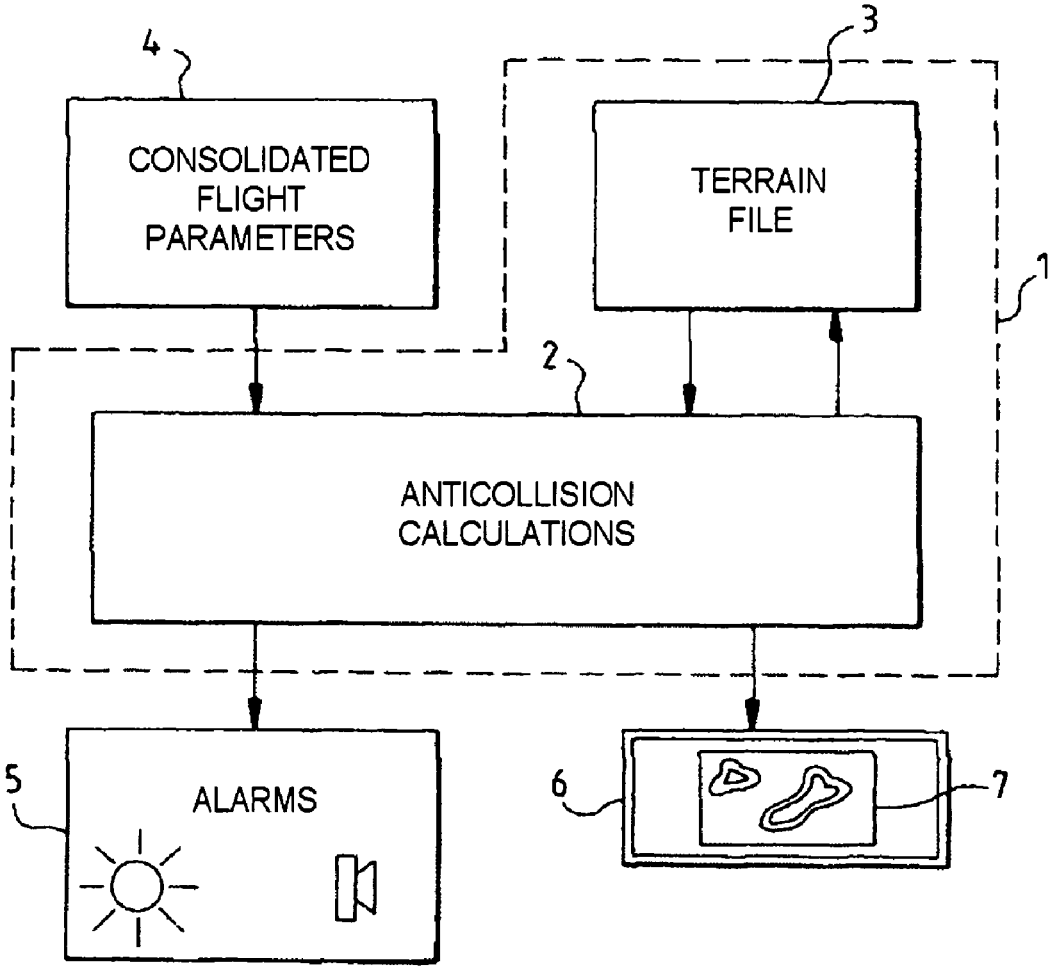

FIG. 1 shows terrain anticollision equipment 1 in its functional environment onboard an aircraft. The terrain anticollision equipment is essentially composed of a computer 2 associated with a cartographic data base 3. The cartographic data base represented 3 is carried onboard the aircraft but it could equally well be on the ground and accessible from the aircraft by radio transmission. The computer 2 may be a computer specific to the terrain anticollision equipment or a computer shared with other tasks such as flight management or automatic pilot. As regards the terrain anticollision, it receives from the navigation equipment 4 of the aircraft the main flight parameters including the position of the aircraft in latitude, longitude and altitude and the direction and the amplitude of its speed vector. On the basis of these flight parameters, it determines at each instant at least two maneuver protection volumes directed toward the front according to a predicted future trajectory and toward the underneath of the aircraft, and searches to ascertain whether these protection volumes come into contact with the terrain and/or the ground obstacles overflown by comparing these maneuver protection volumes with a representation of the terrain and/or of the ground obstacles overflown as derived from the cartographic data base 3, any contact being regarded as a risk of collision with terrain and/or ground obstacles. It emits a prealarm 5 as soon as the most distant of the protection volumes is touched and an alarm if the closest of the protection volumes is also touched, and accompanies the alarm with the reason for the alarm and possibly with an indication as to the suitable avoidance cue.

Additionally, to provide the crew of the aircraft with a picture of the situation of the aircraft with respect to the terrain and to the obstacles overflown, and, possibly, to facilitate for them the evaluation and the resolution of the risks of terrain collision, the terrain anticollision equipment 1 may bring about the display on a screen 6 of the cockpit of a map of the terrain overflown demarcating the threatening terrain zones. This map, generally in two dimensions, consists of a representation by level curves 7 of the terrain overflown with false colors and/or various textures and/or symbols depicting the magnitude of the risk of collision corresponding to each slice of terrain.

An aircraft related protection volume delimits a part of space in which the aircraft must be able to deploy in a more or less near future without risk of terrain collision. Its significance and its form depend on the delay sought between an alarm and the realization of a risk of collision, and, to a certain measure, on the manoeuvrability of the aircraft at the instant considered, that is to say on the aircraft's maneuver capabilities which are related to its performance, to the amplitude and to the direction of its air speed, and to its flight attitude (flight in a straight line or turn, etc). It is defined by a virtual envelope with no physical reality, of which only the lower and frontal and possibly lateral parts are considered.

The lower and frontal parts of a protection volume are customarily regarded as a band, of horizontal transverse axis, following, with a certain vertical offset dependent on the minimum margin of overfly for the situation considered, the trajectory which would be followed by the aircraft in the case where its crew had just been warned of a risk of terrain collision and would have it adopt, after a normal reaction time supplemented with a more or less long safety margin, a climb avoidance trajectory, with a slope near to the maximum of its capabilities at that moment. This band keeps widening to take account of the ever greater uncertainty as to the scheduled position of the aircraft in tandem with the increasing of the forecast delay and opens up on the side in the case of a turn as a function of the turn rate. It begins by directing itself in the direction of the movement of the aircraft, then it curves upward until it adopts a climb slope corresponding to the maximum of the climb capabilities of the aircraft. It serves as feeler since it is its overshooting by the terrain and/or the ground obstacles which serves as criterion for deciding the penetration of the terrain and/or of the ground obstacles into the protection volume and admitting the existence of a risk of collision.

Figure 2:
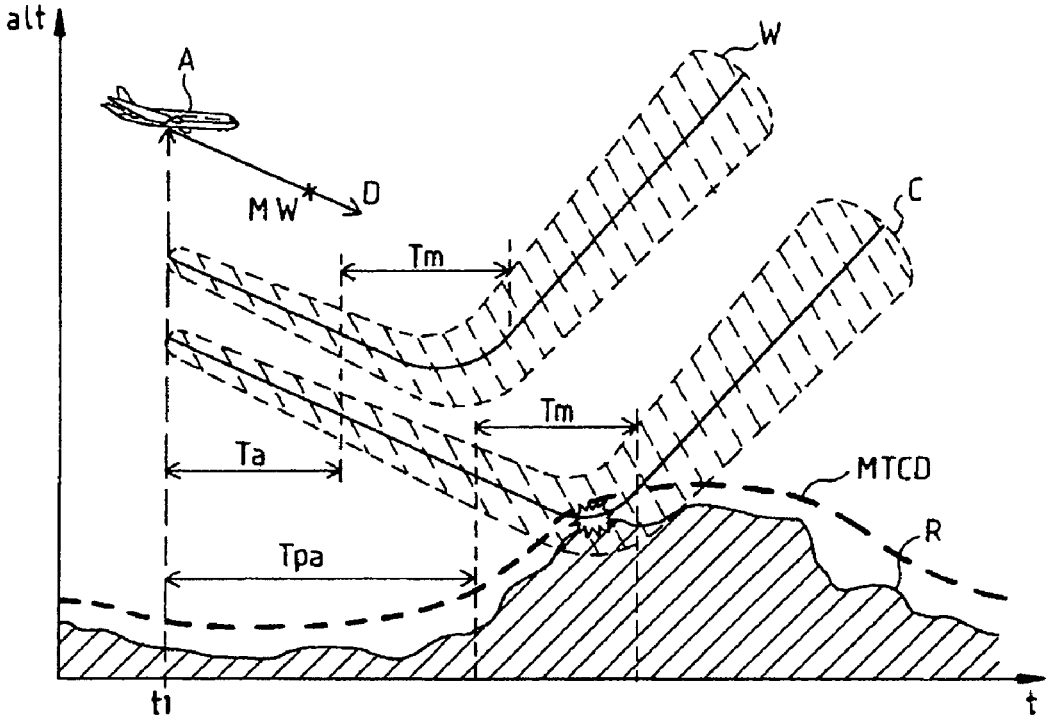
FIGS. 2 to 4 are views, essentially in the vertical plane, showing various phases of a terrain avoidance undertaken by an aircraft under the control of terrain anticollision equipment according to the invention.

In FIG. 2, an aircraft A is moving, descending, at an instant t1 and in a direction D, above a terrain of vertical profile R. This aircraft A is provided with terrain anticollision equipment which implements two maneuver protection volumes: a distant protection volume used for prealarms and hence for the detection of short term terrain collision risks and corresponding to a first feeler C, and a close protection volume used for alarms and hence for the detection of very short term risk of terrain collision and corresponding to a second feeler W. The two feelers C and W used for the prealarms and the alarms model upward relief avoidances instigated at instants t1+Tpa and t1+Ta and requiring an implementation time Tm. The detection of the short term terrain collision risks involves forecasting the upward avoidance maneuver after a delay greater than the detection of the very short term terrain collision risks, this translating into an offset of the feeler C with respect to the feeler W according to the predicted future trajectory. As it relies on a longer term forecast of the position of the aircraft, it is less reliable. However, in order to afford it the same sureness of detection its feeler C is also offset downward with respect to the feeler W.

In the situation represented in FIG. 2, the anticollision equipment of the aircraft A detects a penetration of the terrain through its feeler C at the instant t1 and records, as a consequence, a prealarm of risk of terrain collision. This prealarm alerts the crew of the aircraft A to the risk incurred due to its descent trajectory.

Having arrived at the point MW, the terrain anticollision equipment of the aircraft A produces a terrain collision risk alarm since the closest protection envelope adopted EW meets a surface MTCD overlapping the relief R and corresponding to a minimum safety margin selected to take account of the inaccuracies of the cartographic data base 3 and/or of the vertical position of the aircraft as provided by the onboard sensors, and of a minimum overfly height to ensure safety.

This terrain collision alarm leads the crew of the aircraft to stop the descent and to immediately instigate an avoidance trajectory TE consisting of a climb back to a safety altitude above the high points of the relief overflown.

Figure 3:
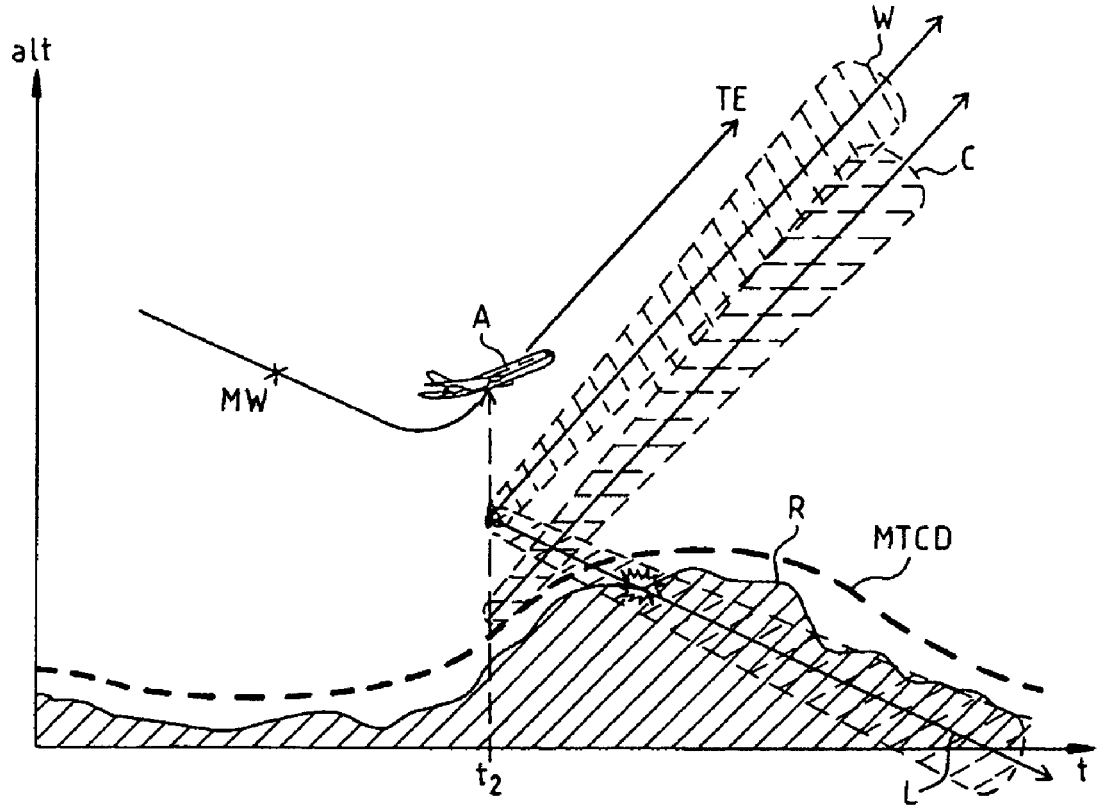

FIG. 3 shows situation of the aircraft A at a later instant t2 while it instigates a reclimb to eliminate the risk of terrain collision signaled by the alarm of its terrain anticollision equipment. The feelers C and W have taken the new climb direction of the aircraft A and have straightened out since the aircraft A is close to the maximum of its climb capabilities. They no longer meet the surface MTCD overlapping the terrain R so that the terrain anticollision equipment of the aircraft A has caused the terrain collision alarm to cease. The stoppage of the alarm (aural and luminous as the case may be) informs the crew of the proper effectiveness of the upward avoidance maneuver in progress but does not advise them as to the possibility or otherwise of resuming the descent trajectory that they were following before the advent of the terrain collision alarm. To fill this gap, the terrain anticollision equipment proposed provides for at least a third so-called resumption of route protection volume, based on the instantaneous position of the aircraft A, here at t2, and on a forecast of fictitious movement going in the direction of the resumption of the trajectory followed at the moment of the detection of the risk with the terrain (prealert or alert). In the present case, the resumption of route protection volume is based on a forecast of fictitious movement resuming the instantaneous heading of the aircraft A and its initial descent slope, and corresponds to the feeler L. This feeler L meets the surface MTCD overlapping the terrain R signifying that the upward avoidance maneuver in progress must be continued before the terrain collision risk may be regarded as resolved.

As soon as the feeler L corresponding to the resumption of route protection volume is freed of any clutch on the MTCD surface overlapping the terrain R, the terrain anticollision equipment emits, for the attention of the crew, a noting of resolution of the risk of terrain collision, signifying the possibility of resuming the route initially followed. This noting may take the form either of the stoppage of an aural and/or luminous cue to continue the avoidance maneuver (such as "continue climb") which has been initiated since the stoppage of the alarm, or of the momentary generation of an aural and/or luminous cue of possible end of the avoidance maneuver.

Figure 4:
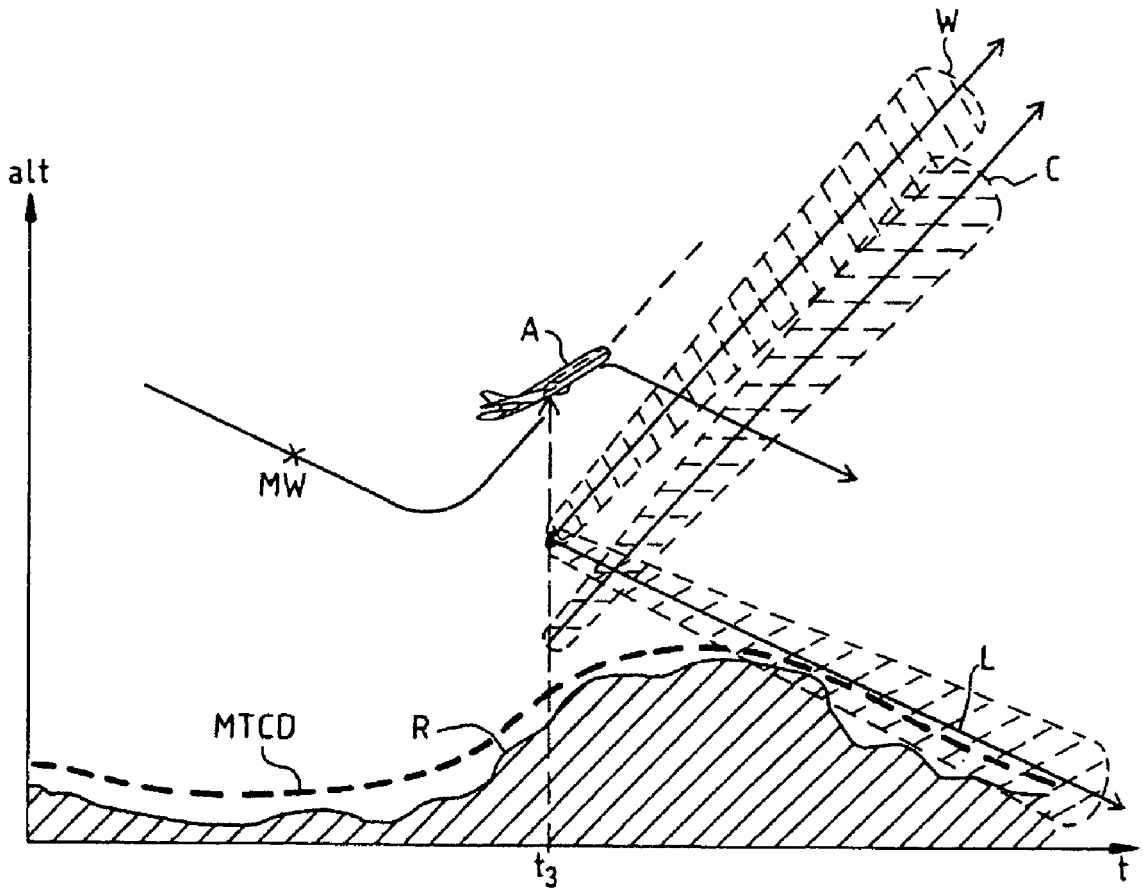

FIG. 4 shows situation of the aircraft A at a later instant t3 while it continues its upward avoidance maneuver instigated to eliminate the risk of terrain collision signaled by the alarm of its terrain anticollision equipment. The feelers C and W remain oriented in climb without meeting the terrain R so that the terrain anticollision equipment of the aircraft A emits no prealarm or alarm. As soon as the feeler L corresponding to the resumption of route protection volume no longer meets the surface MTCD overlapping the terrain R signifying that the upward avoidance maneuver in progress may be stopped and a horizontal trajectory or advantageously the initial descent trajectory resumed without short term risk of collision with terrain and/or obstacles, the terrain anticollision equipment emits, for the attention of the crew, a note of resolution of the risk of terrain collision, signifying the possibility of resuming the route initially followed. As indicated previously, this note can take the form either of the stoppage of an aural and/or luminous cue to continue the avoidance maneuver (such as "continue climb") which has been initiated since the stoppage of the alarm, or of the momentary generation of an aural and/or luminous cue of possible end of the avoidance maneuver.

The way in which the flight parameters are obtained by the navigation equipment 4 of the aircraft as well as the processing carried out by the computer 2 on the flight parameters and on the elements of the cartographic data base 3 to produce the prealarms, the alarms, the terrain avoidance cues and possibly to display a map with false colors, by level curves of the terrain overflown, will not be detailed so as not to overburden the description. For particulars pertaining thereto, reference may usefully be made to the patents cited previously (French patents FR 2 689 668, FR 2 747 492, FR 2 773 609, FR 2 813 963 and American patents U.S. Pat. Nos. 5,488,563, 5,638,282, 6,088,654, 6,317,663).

Just as for the detection of the risks of terrain collision, there may be several protection volumes, for example two protection volumes for route resumption, the more distant to signal an imminent resolution of a risk of terrain conflict currently being processed and the closer for a noting of actual resolution of a risk of terrain collision. The feeler or feelers associated with resumption of route protection volumes may be determined by the terrain anticollision equipment independently of the feelers associated with the maneuver protection volumes or stem therefrom.

Figure 5:
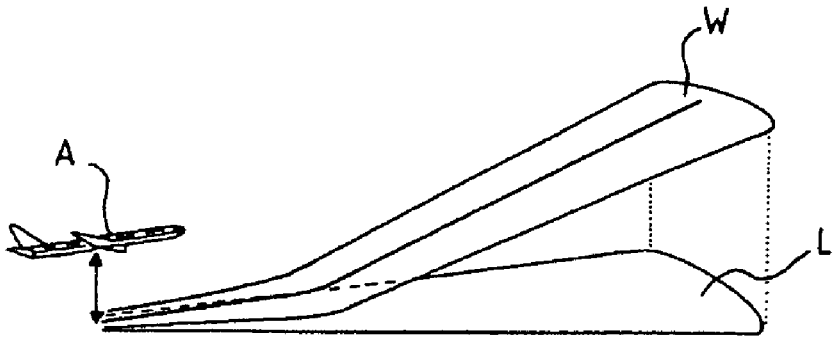
FIGS. 5, 6 and 7 are diagrams illustrating possible choices of feeler of virtual envelope of protection of resumption of route.

FIG. 5 gives an example, in which the feeler L associated with a resumption of route protection volume is taken equal to the projection, onto the horizontal plane, of the feeler W associated with the maneuver protection volume dedicated to the alarms of risk of terrain collision.

A variant consists in adopting for the feeler L associated with the resumption of route protection volume not the projection, onto the horizontal plane, of the feeler W associated with the maneuver protection volume dedicated to the alarms of risk of terrain collision, but the union of the projections, onto the horizontal plane, of the feelers W and C associated with the maneuver protection volumes dedicated to the prealarms and alarms of risks of terrain collision.

Figure 6:
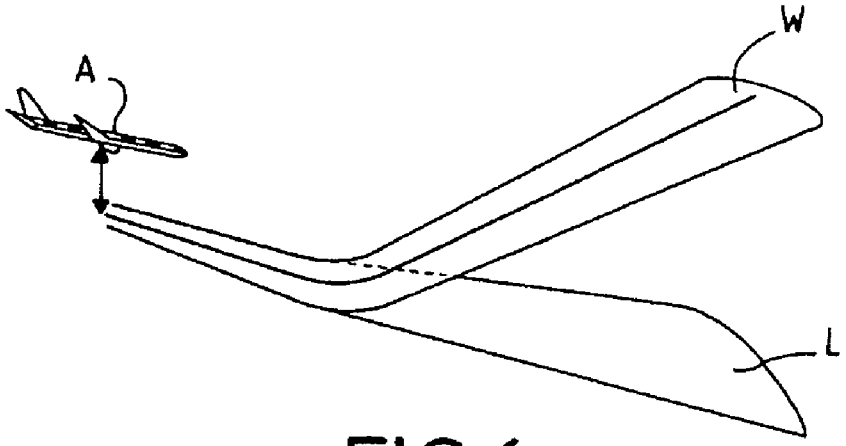

FIG. 6 gives another example particularly suited to the case where an aircraft A is either instantaneously in the process of descending during the resolution of a risk of collision with the terrain (a priori in the process of straightening toward a climb trajectory), or descending at the moment of the detection of a risk of terrain collision. In this example, the feeler L associated with a resumption of route protection volume is taken equal to the projection, onto the plane of descent of the aircraft A, of the feeler W associated with the maneuver protection volume dedicated to the alarms of risk of terrain collision.

A variant consists in adopting for the feeler L associated with the resumption of route protection volume not the projection, onto the plane of descent of the aircraft A, of the feeler W associated with the maneuver protection volume dedicated to the alarms of risk of terrain collision but the union of the projections, onto the plane of descent of the aircraft A, of the feelers W and C associated with the maneuver protection volumes dedicated to the prealarms and alarms of risks of terrain collision.

Figure 7:
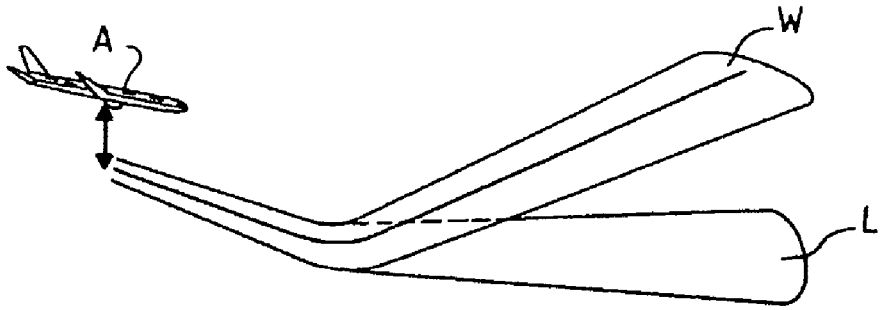

FIG. 7 gives another example particularly suited to the case where an aircraft A is instantaneously in the process of descending during the resolution of a risk of collision with the terrain (a priori in the process of straightening toward a climb trajectory) in which the feeler L associated with a resumption of route protection volume is taken equal to the projection, onto the plane of descent of the aircraft A, for a duration (or a distance) which is predetermined (for example of the order of 30 seconds), then onto a horizontal plane, of the feeler W associated with the maneuver protection volume dedicated to the alarms of risk of terrain collision. Advantageously this projection is defined consistently with that used for the representation of the terrain layers and/or of risk with the terrain and/or the obstacles on the display screen or screens of the cockpit used for this terrain anticollision system, in particular by taking for the predetermined duration a duration for example of the order of 30 seconds fixed or modulable according to criteria peculiar to the displaying of the terrain layers.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. Terrain anticollision equipment to be carried onboard an aircraft, comprising:

means for determining a virtual envelope of protection of maneuver constructed around the short term predicted trajectory of the aircraft and delimiting a protection volume around the current position and the current trajectory of the aircraft, means for detecting intrusions, into said virtual envelope of protection of maneuver, of a representation of an envelope of the terrain and/or of the ground obstacles overflown stored in a data base, alarm means for alerting of a risk of terrain collision, triggered by the intrusion detection means each time said detection means detect a terrain and/or ground obstacle intrusion in the virtual envelope of protection maneuver;

wherein after detection of a risk of ground collision, the means for determining virtual envelope of protection determine, in addition to the virtual envelope of protection of maneuver, a virtual envelope of protection of resumption of route constructed around a fictitious trajectory of resumption of route, wherein the means for intrusion detection detect the intrusions of the terrain and/or of the ground obstacles at one and the same time into the virtual envelope of protection of maneuver and into the virtual envelope of protection of resumption of route; and wherein the alarm means produce an indication signaling the possibility of ending an avoidance maneuver as soon as the means for intrusion detection no longer note any intrusion of the terrain and/or of the ground obstacles into the virtual envelope of protection of resumption of route.

2. The equipment as claimed in claim 1, wherein the fictitious trajectory of resumption of route is a horizontal trajectory.

3. The equipment as claimed in claim 1, wherein the fictitious trajectory of resumption of route is a trajectory having as slope a horizontal slope when the instantaneous trajectory of the aircraft is climbing or holding level, and a slope dependent on the instantaneous trajectory of the aircraft when the aircraft is descending.

4. The equipment as claimed in claim 1, wherein the fictitious trajectory of resumption of route is a trajectory having as slope a slope dependent on the instantaneous trajectory of the aircraft.

5. The equipment as claimed in claim 4, wherein the fictitious trajectory of resumption of route is a trajectory having as slope a slope dependent on the trajectory of the aircraft at the moment of the detection of the risk of terrain collision.

6. The equipment as claimed in claim 1, wherein the fictitious trajectory of resumption of route is a trajectory having as slope a slope dependent on the trajectory of the aircraft at the moment of the detection of the risk of terrain collision, when the aircraft was descending, and a horizontal trajectory when the aircraft was flying horizontally or climbing at the moment of the detection of the risk of terrain collision.

7. The equipment as claimed in claim 1, wherein the fictitious trajectory of resumption of route is a trajectory having as heading the instantaneous heading of the aircraft.

8. The equipment as claimed in claim 1, wherein the fictitious trajectory of resumption of route is a trajectory having as heading and slope those of the trajectory of the aircraft at the moment of the detection of the risk of terrain collision.

9. The equipment as claimed in claim 1, wherein the limits of the virtual envelopes of protection are defined by a so-called feeler surface, the meeting of which with the representation of an envelope of the terrain and/or of the ground obstacles which is extracted from the information of the data base is regarded as an intrusion of the terrain and/or of the ground obstacles into the corresponding virtual envelope of protection.

10. The equipment as claimed in claim 9, wherein, regardless of the instantaneous attitude of the aircraft, the projection onto the horizontal of a feeler of virtual envelope of protection of maneuver is adopted as feeler of a virtual envelope of protection of resumption of route.

11. The equipment as claimed in claim 9, wherein, when the instantaneous attitude of the aircraft is climbing at flying level, the projection onto the horizontal of a feeler of virtual envelope of protection of maneuver is adopted as feeler of a virtual envelope of protection of resumption of route.

12. The equipment as claimed in claim 9, wherein, when the instantaneous attitude of the aircraft is descending, the projection according to an inclined plane dependent on the instantaneous descent slope of the aircraft of a feeler of virtual envelope of protection of maneuver is adopted as feeler of a virtual envelope of protection of resumption of route.

13. The equipment as claimed in claim 1, wherein, when the instantaneous attitude of the aircraft is descending, the projection along an inclined plane dependent on the instantaneous descent slope of the aircraft of a feeler of virtual envelope of protection of maneuver during a certain distance or flight time and then according to the horizontal is adopted as feeler of a virtual envelope of protection of resumption of route.

14. The equipment as claimed in claim 13, wherein, when the terrain anticollision equipment is provided with a display screen showing a representation of the terrain layers and/or of risk with the terrain and/or the obstacles overflown, the projection, in two planes, which is adopted as feeler of a virtual envelope of protection of resumption of route is carried out in a manner consistent with that used on the screen for the representation of the terrain layers and/or of risk with the terrain and/or the obstacles overflown.

15. The equipment as claimed in claim 1, wherein when the aircraft was climbing or holding level at the moment of the detection of the risk of terrain collision, the projection onto the horizontal of a feeler of virtual envelope of protection of maneuver is adopted as feeler of a virtual envelope of protection of resumption of route.

16. The equipment as claimed in claim 1, wherein, when the aircraft was descending at the moment of the detection of a risk of terrain collision, the projection, along an inclined plane having the descent slope of the aircraft at the moment of the detection of the risk of terrain collision, of a feeler of virtual envelope of protection of maneuver is adopted as feeler of a virtual envelope of protection of resumption of route.

17. The equipment as claimed in claim 1, wherein, when the means for determination of virtual envelope of protection produce two virtual envelopes of protection of maneuver, the more distant for a prealarm of terrain collision and the closer for an alarm of terrain collision and when the aircraft is climbing or holding level, the union of the projections onto the horizontal of the feelers of the two virtual envelopes of protection of maneuver is adopted as feeler of a virtual envelope of protection of resumption of route.

18. The equipment as claimed in claim 1, wherein, when the means for determination of virtual envelope of projection produce two virtual envelopes of protection of maneuver, the more distant for a prealarm of terrain collision and the closer for an alarm of terrain collision and when the aircraft was descending at the moment of the detection of a risk of terrain collision, the union of the projections, along an inclined plane having the descent slope of the aircraft at the moment of the detection of the risk of terrain collision, of the feelers of the two virtual envelopes of protection of maneuver is adopted as feeler of a virtual envelope of protection of resumption of route.

19. The equipment as claimed in claim 1, wherein, the indication signaling the possibility of ending an avoidance maneuver is given momentarily in aural and/or visual form.

20. The equipment as claimed in claim 1, wherein, it produces an indication of holding of the avoidance maneuver in aural and/or visual form, upon the disappearance of a terrain alert and does so, until no risk of collision is detected by the virtual envelope of protection of resumption of route.

21. The equipment as claimed in claim 1, wherein the vertical distance under the aircraft at which a virtual envelope of protection of resumption of route is taken equal to that used for one of the virtual envelopes of protection of maneuver.

22. The equipment as claimed in claim 21, wherein, when the terrain anticollision equipment is provided with a display screen showing a representation of the terrain layers and/or of risk with the terrain and/or the obstacles overflown, the vertical distance under the aircraft at which a virtual envelope of protection of resumption of route is placed is taken consistent with that used on the screen for the representation of the terrain layers and/or of risk with the terrain and/or the obstacles overflown.

* * * * *